US005147756A

United States Patent [19]

Fodor

[11] Patent Number: 5,147,756

[45] Date of Patent: Sep. 15, 1992

[54] STABILIZED, AQUEOUS HYDRAZIDE SOLUTIONS FOR PHOTOGRAPHIC ELEMENTS

[75] Inventor: Ludovic Fodor, Jamesburg, N.J.

[73] Assignee: E. I. Du Pont de Nemours and Company, Wilmington, Del.

[21] Appl. No.: 684,132

[22] Filed: Apr. 11, 1991

[51] Int. Cl.[5] ..... G03C 1/34

[52] U.S. Cl. ..... 430/264; 430/598; 430/607; 430/613

[58] Field of Search ..... 430/264, 598, 607, 613

[56] References Cited

U.S. PATENT DOCUMENTS 4,937,160 6/1990 Rüger ..... 430/264

OTHER PUBLICATIONS

Research Disclosure 23510, Nov. 1983.

*Primary Examiner*—Hoa Van Le

[57] ABSTRACT

A process for stabilizing aqueous solution of aryl hydrazides is described. These solutions may be made by the addition of a stabilizing amount of ascorbic acid, isoascorbic acid, erythorbic acid, tartaric acid, citric acid. glucose and a cyclodextrin, etc., or mixtures, for example. When aqueous solutions of aryl hydrazides containing these stabilizers/antioxidants are prepared, the solution will have a shelf life of up to 30 days compared to 1-3 hours of solutions without the stabilizer/antioxidant. The stabilized aryl hydrazide is useful in photographic silver halide emulsions, etc.

7 Claims, No Drawings

STABILIZED, AQUEOUS HYDRAZIDE SOLUTIONS FOR PHOTOGRAPHIC ELEMENTS

TECHNICAL FIELD

This invention relates to a process for preserving aqueous solutions of aryl hydrazide compounds prior to addition to silver halide elements.

BACKGROUND OF THE INVENTION

Photographic, silver halide elements having very high contrast are conventionally used in the field of reprography for the production of screened images from halftone recording elements, in photo typesetting technology, in line transparencies and photomasks among others. By the term "ultrahigh" in photographic systems I mean that the contrast is much higher than can be normally expected if it is assumed that each individual emulsion grain is exposed and developed independently of its neighbors. Ultrahigh systems utilize, for example, effects in which the development of a grain will initiate the development of a neighboring grain even if this grain was not exposed sufficiently to be developable by itself. This phenomena is conventionally known by the term "infectious development" and is well-known to those skilled in the art.

There are a number of conventional photographic systems which produce the aforementioned effects. These are the litho systems wherein a great majority of the grains within the silver halide element are silver chloride grains and these systems are developed in typical hydroquinone-containing developers at a relatively high pH. Additionally, these developers are characterized by a low sulfite content and the absence of any superadditive developer compounds. The problem with these litho systems is that they are relatively slow and require an induction period before the infectious development and the high contrast are achieved.

Silver halide photographic systems which employ hydrazines have been proposed. These hydrazine-containing systems, which are well-described in Research Disclosure 23510, November, 1983, and the references contained therein, are usually based on phenylformylhydrazine and derivatives thereof. These hydrazine-containing systems can produce the desired ultrahigh contrast effects and are considerably faster than conventional litho systems. However, these known hydrazine-containing systems also require higher pH development and it has always been a desire within the industry to reduce the pH of developing solutions because of the effect on the environment. Additionally, the image quality of these films is substantially poorer than conventional photographic litho elements.

Rüger, U.S. Pat. No. 4,937,160, the pertinent disclosure of which is incorporated herein by reference, describes a certain class of aryl hydrazides that will, when added to a gelatino, silver halide emulsion, produce the desired ultrahigh contrast effect in a developer solution at a lower pH than those prior art hydrazines described in Research Disclosure 23510. Many of the aryl hydrazides disclosed in Rüger U.S. Pat. No. 4,937,610 can be added to the emulsion as an aqueous solution or a semi-aqueous solution, e.g., mixture of water and an alcohol. This is a great advantage since gelatino silver halide emulsions are much more receptive to this type of solution and other hydrazines must be added dissolved or mixed in organic solvents. The problem with the use of these aqueous solutions of the said aryl hydrazides described by Rüger is that they have a limited shelf-life, e.g., a few hours or less, and thus must be frequently renewed. Additionally, these compounds are still only partially soluble in a mixture of alcohol and water and only very dilute solutions are possible. Thus, it is desirable to increase the shelf-life and increase the concentration of these aqueous solutions and to improve the stability thereof.

It is an object of this invention to provide a method for stabilizing aqueous solutions of aryl hydrazides which are to be added to gelatino silver halide emulsions.

SUMMARY OF THE INVENTION

In accordance with this invention there is provided a process for the stabilization of an aqueous solution of an aryl hydrazide of the general formula:

$$Ar13\ NR—NR_1—G—X^+ \qquad A^-$$

wherein:

Ar is a substituted phenyl group or another substituted or unsubstituted aryl group;

G is CO, SO, $SO_2$, $PO_3$, and $C{=}NR_2$;

$X^+$ is a radical containing a cationic group;

R, $R_1$, $R_2$, which can be the same or different, are hydrogen, alkyl of 1–6 carbon atoms, and alkyl sulfinyl of 1–6 carbon atoms; and $A^-$ is an anion, the improvement comprising adding to said aqueous solution a stabilizing amount of a stabilizer/antioxidant selected from the group consisting of ascorbic acid, an ascorbic acid isomer, tartaric acid, citric acid, glucose, α-cyclodextrin, β-cyclodextrin and gamma-cyclodextrin, and mixtures thereof.

DETAILED DESCRIPTION OF THE INVENTION

The general class of aryl hydrazides that are useful within the ambit of this invention are disclosed in the Rüger U.S. Pat. No. 4,937,160. Particularly preferred compounds include those with the following structure:

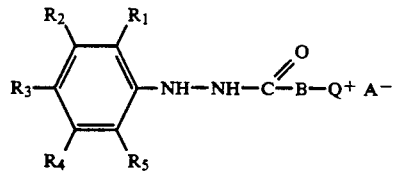

wherein $R_1$ to $R_5$, which can be the same or different, are hydrogen, alkyl, alkoxy, hydroxyalkyl, haloalkyl, alkylamino, aliphatic acylamino or cycloalkyl, each with 1–20 carbon atoms; aryl, aryloxy or aromatic acylamino, each with 6–10 carbon atoms in the alkylene chain; or an aliphatic acylamino radical with 1–4 carbon atoms substituted by a phenoxy radical which may be substituted by one or more alkyl radicals with 1–10 carbon atoms, with the proviso that at least one of $R_1$ to $R_5$ is not hydrogen, $Q^+$ is a trialkyl ammonium, pyridinium-1-yl, N-alkylpyridinium-m-yl where m is a whole number of 2, 3 or 4, thiazolinium-3-yl or N-alkylthiazolinium-m-yl where m is 2, 4 or 5, in which the heterocyclic rings may be substituted by additional alkyl radicals, and in which all alkyl groups of a radical $Q^+$ may be the same or different and/or may be substituted by a hydroxyl or sulfonic acid group, each alkyl group having no more than 12 carbon atoms, but in the case of trialkylammonium, two of them may also form with the quaternary nitrogen, a ring with 3–4 members, B is a bridge when may be composed of 1–3 methylene groups, each of which may be substituted by methyl or ethyl, or if $Q^+$ is N-alkylpyridinium-m-yl or N-alkylthiazolinium-m-yl, may also be an oxygen atom or a single bond, and, $A^-$ denotes an anion which is not present when $Q^+$ contains a sulfo group. Bromine and chlorine are examples of anions but other anions can be used.

A most particularly preferred compound has the following structure:

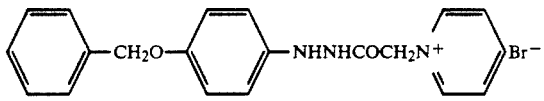

Generally, these compounds may be made up in a mixture of 50% water and 50% of a lower alcohol, e.g., methyl alcohol. When the stabilizer/antioxidants of this invention are present, the solution may be all water. This mixture contains conventionally about 0.4% by weight of the aryl hydrazide compound and must be added to the silver halide emulsion within 1–24 hours after being made. Otherwise, solids will precipitate and the solution degrades rapidly and loses its effects. In order to overcome this degradation effect, I have found that I can add a stabilizing amount of ascorbic acid, an isomer of ascorbic acid, e.g., isoascorbic acid, erythorbic acid, etc.; tartaric acid, citric acid, glucose, or an α-, β- , or gamma-cyclodextrin, or mixture thereof to this solution during the manufacture thereof. By adding one or more of these of these stabilizer/antioxidants, I am able not only to increase the stability of the solution of aryl hydrazide from a few hours to 2 weeks or more, but I can make up to a 2% by weight solution of the aryl hydrazide. This permits the addition of less solution in order to achieve the desirable ultrahigh contrast results along with all of the other benefits known to accrue when using these aryl hydrazides. The increased stability of the solution is highly beneficial within the photographic silver halide manufacturing system since most solutions which are designed to be added to a silver halide emulsion are usually made up well in advance of the preparation date.

The stabilizer/antioxidants of this invention can be added to the mixture of alcohol and water or in water alone at a concentration of from 0.01 to 10.0% by weight, and preferably from 0.5 to 2.0% by weight. Mixtures of two or more of these stabilizer/antioxidants may be used, in fact it is so preferred. A particularly preferred mixture is from 0.5 to 2.0% by weight of ascorbic acid and 0.5 to 2.5% by weight of β-cyclodextrin. The cyclodextrins have a formula and are described in *The Merck Index,* Tenth Edition, page 389, shown as Compound No. 2712.

When I make up the preferred solution which will contain the aryl hydrazide, I first mix equal amounts of distilled or deionized water and methyl alcohol. Then, I add the desired amount of the stabilizer/antioxidant of this invention and the aryl hydrazide. Stirring for a period of time at 150° F. (65° C.) will insure complete solution. The solution made with the antioxidant will be clear and retain its stability for a reasonable length of time, e.g., 15 to 30 days vs. only a few hours without the stabilizer/antioxidant. The stability of the solution can be observed visually. Solutions made up without stabilizer/antioxidant generally will form solids and become more colored after a short period of time, e.g., after 1 to 24 hours. Those with the stabilizer/antioxidant compounds of this invention show no solids and only a slight color which essentially remains the same over the life of the solution. Additionally, it is possible to measure the amount of aryl hydrazide present in the solution using spectral analysis. Thus, if the aryl hydrazide becomes oxidized or degrades in some other way, the spectral analysis will confirm this fact. Solutions made according to the teachings of this invention show none of this degradation up to 30 days of shelf life while those without the stabilizer/antioxidants show considerable degradation within 1 to 24 hours, as measured spectrally. The degradation of these products may also be measured using thin layer chromatography as known to those skilled in the art.

EXAMPLES

This invention will now be illustrated by the following examples wherein the percentages and parts are by weight. Example 4 is considered be the best mode at the time of filing.

EXAMPLE 1

Four samples of Compound A, described above were dissolved as further described to obtain ca. 2% solutions. In Sample 1, the compound was dissolved without further treatment (Control) in methanol. In Sample 2, the compound was first recrystallized in the presence of ascorbic acid before making up the solution in methanol. In Sample 3 the compound was dissolved in the presence of 5% of ascorbic acid in water, and the last sample was dissolved in 5% acetic acid in water. Each sample was thoroughly mixed to insure complete solution and the stability of each tested using thin layer chromatography using Type 13181, Eastman Chromatogram sheets. The chromatograph of each was analyzed. From the spots found thereon, the following results were determined as set out in Table 1.

TABLE 1

| Sample | Procedure | Results |
|---|---|---|
| 1 (Control) | No addition or treatment | High level of degrad.; solids noted |
| 2 | Recryst. from Ascorbic Acid | some degrad.; Some solids noted |
| 3 | With ascorbic acid present | No degradation; no solids |
| 4 | With acetic acid present | High level of degrad.; solids noted |

This example shows that even when the aryl hydrazide is recrystallized in the presence of some ascorbic acid, the stability of a solution made thereof will be increased. The presence of other acids does not affect the stability of these solutions. It should also be noted that by using ascorbic acid this compound is stable in an aqueous solution.

EXAMPLE 2

Compound A was first purified by recrystallization from water and then dissolved in water. This solution contained 1% of Compound A and 5.0% of ascorbic acid. The solution was stirred to insure complete solution and then filtered to remove any trace amounts of solids. The solution was held for a period of 4 days and the color remained clear with a slight yellow tinge and no solids appeared. This indicated that this solution was highly stable over a long period of time. A spectral analysis also showed essentially no degradation had occurred over this period of time.

EXAMPLE 3

In order to test the efficacy of other compounds within the metes and bounds of this invention, two samples of Compound A were made up in water (2% solution). Additionally, 5% of either citric acid or L-tartaric acid were added to each solution. Both solutions were stable as measured by spectral response.

EXAMPLE 4

Two samples of Compound A were made up. One was kept as a control. To the other, 5.7% of β-cyclodextrin and 1% of ascorbic acid was also added. Both were made up in all water. In the case of the control, there were considerable solids left and the solution aged poorly as indicated by increasing color. In the case of the sample containing the β-cyclodextrin, the solution remained clear and there was little evidence of solids formation. This indicated that the solution containing the β-cyclodextrin was considerably more stable than the control. This fact was also shown by a measurement of the spectral response of both solutions which indicated that the aryl hydrazide was decomposing in the control.

EXAMPLE 5

The following solution was prepared:

| | |
|---|---|
| Water | 50.00 cc |
| β-cyclodextrin | 2.84 gm |
| L-ascorbic acid | 0.54 gm |
| Compound A | 1.03 gm |

This solution was stirred at room temperature until all solids dissolved. There was little evidence of solids formation and the solution was clear. Spectral analysis indicated no degradation of the aryl hydrazide indicating that this was a stable solution.

EXAMPLE 6

A gelatino silver halide emulsion containing 100 mol percent of bromide was prepared and brought to its optimum sensitivity with gold and sulfur as well known to those of ordinary skill in the art. This procedure is taught in Example 5 of Rüger U.S. Pat. No. 4,937,160. Compound A was added to this emulsion at a level of 0.25 gram/unit (161 grams silver is a unit), and the emulsion was then coated on a polyester support and overcoated with a standard, hardened gelatin antiabrasion layer. Samples of this coating were taken and exposed as described in Example 5 of Rüger U.S. Pat. No. 4,937,160. These exposed samples were then developed in a high contrast developer and excellent results were obtained. The dot quality was good and the speed of the system was high indicating that the stabilized aryl hydrazide solution functioned well.

What is claimed is:

1. A process for the stabilization of an aqueous solution of an aryl hydrazide of the general formula:

$$Ar—NR—NR_1—G—X^+ \qquad A^-$$

wherein:

Ar is a substituted phenyl group or another substituted or unsubstituted aryl group;

G is CO, SO, $SO_2$, $PO_2$, $PO_3$, and $C{=}NR_2$;

$X^+$ is a radical containing a cationic group;

R, $R_1$, $R_2$, which can be the same or different, are hydrogen, alkyl of 1-6 carbon atoms, and alkyl sulfinyl of 1-6 carbon atoms; and $A^-$) is an anion, the improvement comprising adding to said aqueous solution a stabilizing amount of a stabilizer/antioxidant selected from the group consisting of ascorbic acid, an ascorbic acid isomer, tartaric acid, citric acid, glucose, α-cyclodextrin, β-cyclodextrin and gamma-cyclodextrin, and mixtures thereof.

2. A process according to claim 1 wherein said aryl hydrazide has the following structure:

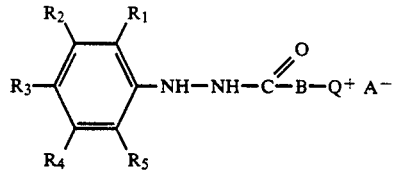

wherein $R_1$ to $R_5$, which can be the same or different, are hydrogen, alkyl, alkoxy, hydroxyalkyl, haloalkyl, alkylamino, aliphatic acylamino or cycloalkyl, each with 1-20 carbon atoms; aryl, aryloxy or aromatic acylamino, each with 6-10 carbon atoms in the alkylene chain; or an aliphatic acylamino radical with 1-4 carbon atoms substituted by a phenoxy radical which may be substituted by one or more alkyl radicals with 1-10 carbon atoms, with the proviso that at least one of $R_1$ to $R_5$ is not hydrogen, $Q^+$ is a trialkyl ammonium, pyridinium-1-yl, N-alkylpyridinium-m-yl where m is a whole number of 2,3 or 4, thiazolinium-3-yl or N-alkylthiazolinium-m-yl where m is 2,4 or 5, in which the heterocyclic rings may be substituted by additional alkyl radicals, and in which all alkyl groups of a radical $Q^+$ may be the same or different and/or may be substituted by a hydroxyl or sulfonic acid group, each alkyl group having no more than 12 carbon atoms, but in the case of trialkylammonium, two of them may also form with the quaternary nitrogen, a ring with 3-4 members, B is a bridge when may be composed of 1-3 methylene groups, each of which may be substituted by methyl or ethyl, or if $Q^+$ is N-alkylpyridinium-m-yl or N-alkylthiazolinium-m-yl, may also be an oxygen atom or a single bond, and, $A^-$ denotes an anion which is not present when $Q^+$ contains a sulfo group.

3. A process according to claim 1 wherein said aryl hydrazide has the following structure:

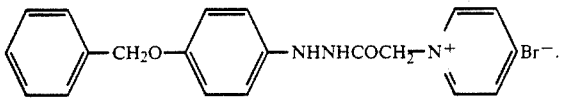

4. A process according to claim 3 wherein said stabilizer/antioxidant is present in an amount from 0.01 to 10.0 percent by weight.

5. A process according to claim 4 wherein said stabilizer/antioxidant is a mixture of L-ascorbic acid and $\beta$-cyclodextrin.

6. A process according to claim 1 wherein an isomer of ascorbic acid is isoascorbic acid or erythorbic acid.

7. A photographic, silver halide emulsion stabilized with a solution according to claim 5.

* * * * *